United States Patent [19]

Fucinato

[11] Patent Number: 4,861,038

[45] Date of Patent: Aug. 29, 1989

[54] GOLF PUTTER

[76] Inventor: Gene J. Fucinato, 21 Belden St., Binghamton, N.Y. 13903

[21] Appl. No.: 7,638

[22] Filed: Jan. 27, 1987

[51] Int. Cl.[4] ..... A63B 53/04

[52] U.S. Cl. ..... 273/169; 273/167 C; 273/168; 273/175

[58] Field of Search ..... 273/167 B, 167 C, 175, 273/167 J, 167 H, 168, 169, 170, 171, 167 A, 167 F, 167 K, 172

[56] References Cited

U.S. PATENT DOCUMENTS

| | | | |
|---|---|---|---|
| 2,174,212 | 9/1939 | Newsome | 273/167 H |
| 2,998,254 | 8/1961 | Rains et al. | 273/168 |
| 3,081,087 | 3/1963 | Redd | 273/167 H |
| 3,394,937 | 7/1968 | Allport | 273/167 b |
| 3,909,005 | 9/1975 | Piszel | 273/175 |
| 4,008,896 | 2/1977 | Gordos | 273/171 |
| 4,508,342 | 4/1985 | Drake | 273/167 C |
| 4,529,202 | 7/1985 | Jacobson | 273/175 |

FOREIGN PATENT DOCUMENTS

| | | | |
|---|---|---|---|
| 14169 | of 1895 | United Kingdom | 273/175 |
| 7550 | of 1900 | United Kingdom | 273/167 B |
| 1129315 | 10/1968 | United Kingdom | 273/169 |

*Primary Examiner*—George J. Marlo

*Attorney, Agent, or Firm*—Neuman, Williams, Anderson & Olson

[57] ABSTRACT

A golf putter is disclosed which includes a shaft, a grip, a hosel and a head. The head is elongated and substantially cylindrical in shape and includes a cavity which is cylindrical and elongated. The cavity is disposed toward the top of the head, thereby lowering the center of gravity of the head. The front of the head is flattened, thereby providing a surface to strike the golf ball and also moving the center of gravity of the head towards the back of the head to improve the ball control. This golf putter imparts true overspin on a golf ball.

4 Claims, 1 Drawing Sheet

12
14
16
18
20
22
24
A
4

GOLF PUTTER

BACKGROUND OF THE INVENTION

This invention relates to a golf putter, and more particularly a structure for imparting true overspin to a golf ball and decreasing skidding of the golf ball as it moves towards its target.

OBJECTS OF THE INVENTION

It is a general object of this invention to provide an improved golf putter, and more particularly, a golf putter which imparts true overspin on the golf ball.

It is a more specific object of this invention to provide an improved golf putter which provides a longer sweet spot on the surface of the face of the golf club, resulting in a reduced number of mis-hits and a consistent ball trajectory.

It is still a further object of this invention to provide a golf putter which has a construction which allows a shorter back swing resulting in a higher percentage of positive contact with the golf ball.

These and yet additional objects and features of this invention will become apparent from the following discussion of the preferred embodiment, and from the attached drawings and appended claims.

SUMMARY OF THE INVENTION

The present invention is an improved golf putter which accomplishes the aforenoted objects. The golf putter includes a head, a hosel, a shaft and a grip. The head has a top, a bottom and a horizontal center line midway between the top and the bottom of the head. The head includes a cavity which is sunstantially disposed above the horizontal center line of the head. By placing the cavity above the horizontal center line of the head, one lowers the center of gravity of the head to the lowest possible point of the head. The head is substantially cylindrical in shape. The front of the head is flattened to provide a striking surface for the golf ball and also for shifting the center of gravity towards the back of the head. Thus, the center of gravity of the club head is lowered by the cavity and shifted towards the back by the flattening of the cylindrical head. Such shifting of the center of gravity allows one to have a shorter backswing of the club resulting in a higher percentage of positive contact with the golf ball and imparts true overspin on the golf ball, resulting in a consistently true trajectory of the golf ball towards its target.

The cylindrical golf club head is rounded on the bottom. The rounding of the golf club head provides less contact with the golfing surface and thereby imparts less drag.

BRIEF DESCRIPTION OF THE DRAWINGS

For a more complete understanding of the invention, reference should now be made to the embodiment as illustrated in greater detail in the accompanying drawings and described below by way of example of the invention.

In the drawings.

Figures 1, 2, 3, 4:
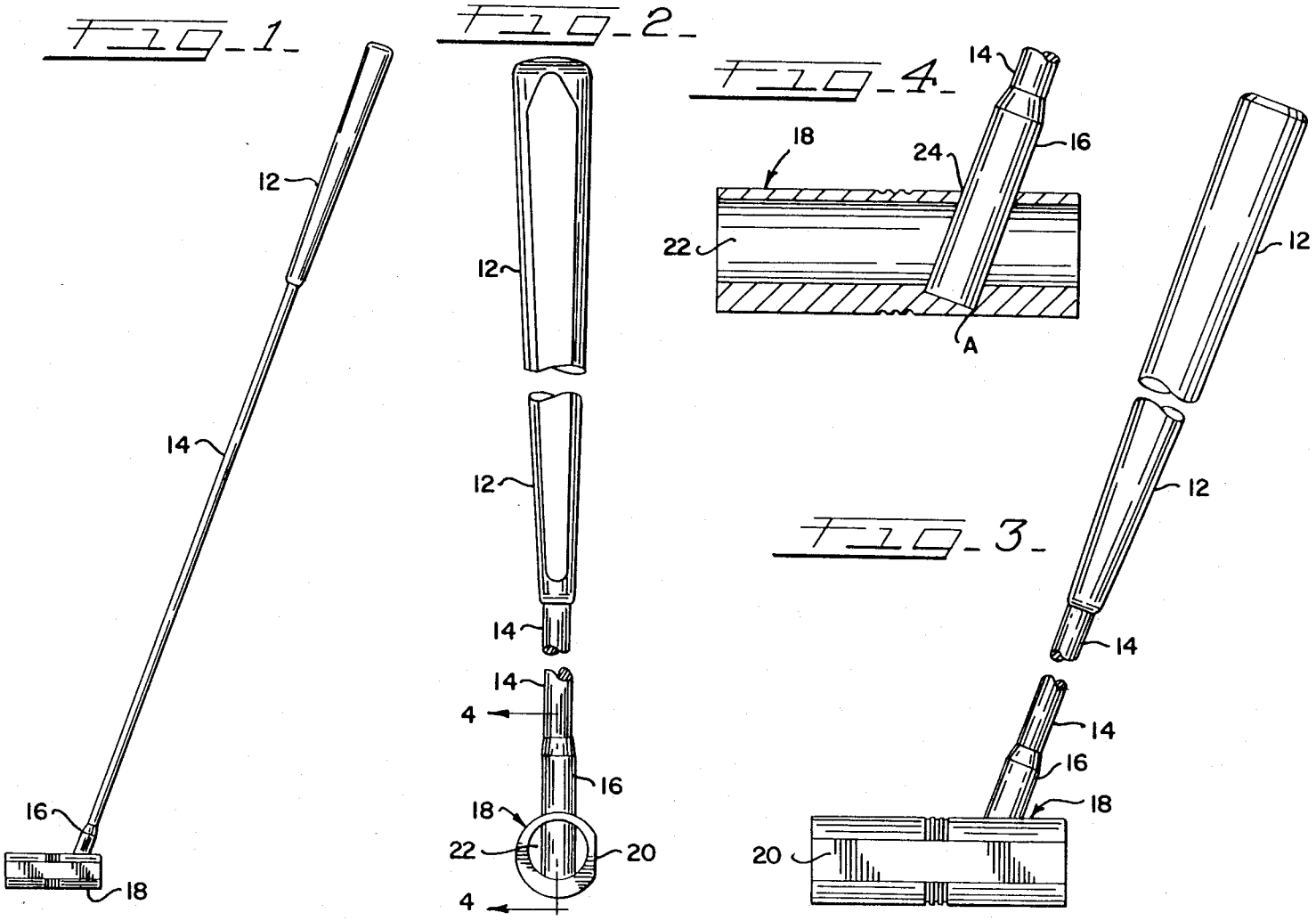
FIG. 1 is a front view of a golf putter employing teachings of this invention.
FIG. 2 is an enlarged, fragmentary view of the putter shown in F 1, rotated 90° from the position shown in FIG. 1.
FIG. 3 is an enlarged, partial, fragmentary view of the unit shown in FIG. 1.
FIG. 4 is an enlarged, partial sectional view taken along line 4—4 in FIG. 2 showing the golf putter of FIG. 1

It should be understood that the drawings are not necessarily drawn to scale and that the embodiment is sometimes illustrated in part by fragmentary views. Details of the actual structure which are not necessary for the understanding of the present invention have been omitted. It should be understood, of course, that the invention does not necessarily limit it to the particular embodiment illustrated herein.

DETAILED DESCRIPTION OF A PREFERRED EMBODIMENT

As shown in FIG. 1, the golf putter of this invention has four basic parts: the grip 12, a shaft 14, a hosel 16 and a club head 18. The grip 12 is a standard putter grip. The shaft 14 is a standard putter shaft.

The hosel 16 integrates the head 18, the shaft 14 and the grip 12. In this particular embodiment, the overall length of the hosel 16 is 2.25 inches and its outside diameter is 0.5 inches. The hosel has an opening machined through its center at the top to enable the end of the shaft 14 to be placed into and connected with the hosel 16. The hosel 16 enables the lie-angle to be changed to suit different preferences of users.

The head 18 has an overall length of 3.625 inches in this particular embodiment. Its outside diameter is 1.25 inches in this particular embodiment. As shown in FIGS. 2–4, the head is substantially cylindrical in shape. The head 18 includes a flattened portion 20. The flattened portion 20 provides the sweet spot for striking the golf ball. The flattening of the head at 20 also results in the center of gravity of the head shifting towards the back of the head. In this particular embodiment, the flattened portion is 0.089 inches deep by 0.625 inches wide along the full length of the club head.

The flattened portion moves the center of gravity further to the rear (opposite the sweet spot) of the club. The shifting of the center of gravity towards the rear of the club head gives the user more control over the putter trajectory as it strikes the golf ball.

The head also includes a cavity 22 which is bored above the horizontal center line of the club head. In this particular embodiment, the cavity 22 is cylindrical in shape and has a diameter of 0.875 inches. The center of the cavity is 0.1 inches above the horizontal center line of the club head. The horizontal center line is the horizontal line disposed midway between the top and the bottom of the club head. As shown in FIGS. 2 and 4, the majority of the volume of the cavity 22 is disposed above the horizontal center line. The cavity 22 being bored off the horizontal center line will drop the center of gravity to the lowest possible point of the head. As shown in FIGS. 2–4, the top of the head extends over the full length of the cavity.

The head 18 has an aperture 24 machined into the top of the head. The aperture 24 in this particular embodiment is 0.5 inches in diameter. The aperture 24 is machined at an angle and accommodates the hosel 16. The angle of the aperture 24 will vary to suit the different preferences of the users. The aperture 24 is machined to a point close to the bottom of the head as shown at point A in FIG. 4.

The golf putter is assembled by inserting the hosel 16 into the head 18 at aperture 24. The shaft is then inserted into the opening provided at the top of the hosel 16. The grip is inserted over the shaft.

The golf putter can be made for either right or left-hand golfers.

The unique design in the golf club establishes the aforenoted objects of the invention. The golf club imparts true overspin due to the lower center of gravity as well as a longer sweet spot. The golf club has less drag because of the rounded surface of the bottom of the club head. The center of gravity is shifted toward the rear of the club head thereby giving more control to the putter trajectory as it strikes the golf ball.

While a particular embodiment of the invention has been shown, it will be understood, of course, that the invention is not limited thereto since modifications may be made and other embodiments of the principles of this invention will occur to those skilled in the art to which this invention pertains, particularly upon considering the foregoing teachings. It is, therefore, contemplated by the appended claims to cover any such modifications and other embodiments as incorporate those features which constitute the essential features of this invention within the true spirit and scope of the following claims.

What is claimed is:

1. A golf putter for putting a golf ball on a golf surface, said golf putter comprising a shaft, a grip and a head, said head having cylindrical top and bottom surfaces, and a horizontal center line midway between said top and said bottom surfaces, and said head further including a cavity, said cavity having a top, wherein said horizontal center line passes through said cavity and the majority of the volume of said cavity is disposed above said horizontal center line so that the center of gravity of the head is located below said horizontal center line, and wherein the top of said head extends over the full length of said cavity.

2. The golf putter of claim 1 wherein said head is elongated and has a first end and a second end, and said head further includes a vertical middle plane midway between said ends and wherein said vertical middle plane bisects said cavity, and wherein the cavity is substantially cylindrical and includes an opening at both of said ends of said head.

3. The golf putter of claim 2 wherein said head is substantially cylindrical in shape and includes a rear surface being rounded and a front surface being flattened thereby providing a surface for striking a golf ball and also further moving the center of gravity towards said rear surface of said head to improve ball control.

4. The method of striking a golf ball with a golf putter, wherein said golf putter comprises a shaft, a grip and a head, said head having a top, a bottom and a horizontal center line midway between said top and said bottom, and said head further including a cavity, said cavity having a top, wherein said horizontal center line passes through said cavity and the majority of the volume of said cavity is disposed above said horizontal center line, thereby lowering the center of gravity of the head below said horizontal center line, and wherein the top of said head extends over the full length of the cavity and wherein the cavity is substantially cylindrical and includes an opening at both ends of said head, and wherein said head is substantially cylindrical in shape and includes a flat front surface, which method comprises the steps of:

(a) gripping the golf putter at the shaft; and (b) striking a golf ball with the front surface of said head, wherein said cavity is substantially empty when said head strikes the golf ball.

* * * * *